US010239653B2

(12) United States Patent
Putko

(10) Patent No.: US 10,239,653 B2
(45) Date of Patent: Mar. 26, 2019

(54) FLAT FOLDABLE PACKAGING

(71) Applicant: Multi Packaging Solutions, Inc., Lansing, MI (US)

(72) Inventor: Bogdan Putko, Gdansk (PL)

(73) Assignee: MULTI PACKAGING SOLUTIONS, INC., Lansing, MI (US)

( * ) Notice: Subject to any disclaimer, the term of this patent is extended or adjusted under 35 U.S.C. 154(b) by 270 days.

(21) Appl. No.: 14/957,042

(22) Filed: Dec. 2, 2015

(65) Prior Publication Data

US 2016/0159515 A1 Jun. 9, 2016

Related U.S. Application Data

(60) Provisional application No. 62/137,284, filed on Mar. 24, 2015, provisional application No. 62/089,410, filed on Dec. 9, 2014.

(51) Int. Cl.
*B65D 5/32* (2006.01)
*B65D 5/02* (2006.01)
(Continued)

(52) U.S. Cl.
CPC ..... *B65D 5/32* (2013.01); *B65D 5/0254* (2013.01); *B65D 5/2057* (2013.01); *B65D 5/248* (2013.01); *B65D 5/327* (2013.01); *B65D 5/4212* (2013.01); *B65D 5/443* (2013.01); *B65D 5/5213* (2013.01); *B65D 5/566* (2013.01); *B65D 5/6602* (2013.01); *B65D 5/6661* (2013.01); *B65D 85/18* (2013.01);
(Continued)

(58) Field of Classification Search
CPC .... B65D 85/18; B65D 85/182; A61B 19/045; A47G 25/54; A45C 3/12
USPC ..... 206/278, 267, 269, 270, 273, 299, 737; 229/100, 101, 106, 108–122, 165
See application file for complete search history.

(56) References Cited

U.S. PATENT DOCUMENTS 564,592 A 7/1896 Craw
1,817,045 A * 8/1931 Tanner ..... B65D 5/524 206/45.29
(Continued)

FOREIGN PATENT DOCUMENTS

BE 486043 A 12/1948
DE 92 02 098 U1 8/1992
(Continued)

OTHER PUBLICATIONS

Extended Search Report dated Aug. 2, 2016; Application No. EP15197489.6.
(Continued)

*Primary Examiner* — Fenn C Mathew
*Assistant Examiner* — Cynthia Collado
(74) *Attorney, Agent, or Firm* — The Dobrusin Law Firm, PC

(57) ABSTRACT

A container having both a one-dimensional configuration before it is formed into its three-dimensional configuration. A blank is used to form the container and is initially flat with a plurality of fold lines. The container includes a base portion with a plurality of edges along its perimeter, a lid portion which is distanced from and parallel to the base portion, and a wall projecting orthogonally from each edge forming a plurality of walls. At least one wall is integrally connected to both the base portion and the lid portion.

19 Claims, 10 Drawing Sheets

(51) Int. Cl.

| | |
|---|---|
| ***B65D 5/42*** | (2006.01) |
| ***B65D 5/66*** | (2006.01) |
| ***B65D 85/18*** | (2006.01) |
| ***B65D 85/68*** | (2006.01) |
| ***B65D 85/00*** | (2006.01) |
| ***B65D 5/20*** | (2006.01) |
| ***B65D 5/24*** | (2006.01) |
| ***B65D 5/44*** | (2006.01) |
| ***B65D 5/52*** | (2006.01) |
| ***B65D 5/56*** | (2006.01) |

(52) U.S. Cl.
CPC ..... *B65D 85/68* (2013.01); *B65D 85/70* (2013.01); *B65D 2313/02* (2013.01); *B65D 2313/04* (2013.01)

(56) References Cited

U.S. PATENT DOCUMENTS

| | | | | |
|---|---|---|---|---|
| 1,839,779 | A * | 1/1932 | Snyder | B65D 5/62 229/125.11 |
| 2,100,644 | A * | 11/1937 | Groves | B65D 5/6673 229/125.37 |
| 2,640,642 | A | 6/1953 | Frankenstein | |
| 2,925,212 | A | 2/1960 | Welsh | |
| 3,286,900 | A | 11/1966 | Keith | |
| 3,756,499 | A | 9/1973 | Giebel et al. | |
| 4,413,726 | A | 11/1983 | Davidson | |
| 5,383,595 | A | 1/1995 | Hallam | |
| 5,586,717 | A | 12/1996 | Hallam | |
| 6,012,631 | A | 1/2000 | Hallam | |
| 7,044,359 | B1 | 5/2006 | Cohen | |
| D682,680 | S * | 5/2013 | Terlesky | D9/432 |
| 2004/0108370 | A1* | 6/2004 | Lee | B65D 5/48002 229/120.13 |
| 2006/0163334 | A1 | 7/2006 | Kay | |
| 2006/0202007 | A1 | 9/2006 | Cohen | |
| 2010/0294831 | A1 | 11/2010 | Hallam | |
| 2011/0155797 | A1 | 6/2011 | Hallam | |
| 2011/0200768 | A1 | 8/2011 | Revell et al. | |
| 2011/0233264 | A1* | 9/2011 | Lombardi | B65D 5/20 229/103 |
| 2011/0272411 | A1* | 11/2011 | Sanders | B65D 5/48018 220/503 |
| 2013/0270133 | A1 | 10/2013 | Kenner et al. | |
| 2013/0299566 | A1 | 11/2013 | Sylvester | |
| 2014/0262932 | A1 | 9/2014 | Lenkeit | |

FOREIGN PATENT DOCUMENTS

| | | | |
|---|---|---|---|
| DE | 20105978 | U1 | 7/2001 |
| DE | 9422452 | U1 | 9/2002 |
| EP | 2072408 | A1 | 6/2009 |
| EP | 2185431 | A1 | 5/2010 |
| EP | 2262692 | A2 | 12/2010 |
| EP | 2592008 | A2 | 5/2013 |
| GB | 2475019 | A | 5/2011 |
| WO | 2006/092018 | A1 | 9/2006 |
| WO | 2006/097683 | A1 | 9/2006 |
| WO | 2007/127742 | A3 | 11/2007 |
| WO | 2009/013542 | A1 | 1/2009 |
| WO | 2009/109783 | A3 | 9/2009 |
| WO | 2010/020815 | A2 | 2/2010 |
| WO | 2010/131040 | A1 | 11/2010 |
| WO | 2001019219 | A2 | 2/2011 |

OTHER PUBLICATIONS

PCT Written Opinion of the International Preliminary Examining Authority dated Apr. 17, 2014; Application No. PCT/US2013/030671.

Canadian Office Action dated Apr. 9, 2014; Appln. No. 2,800,628.

European Extended Search Report dated Oct. 1, 2012, Appln. No. 12164150.

PCT International Preliminary Report on Patentability dated Jul. 17, 2014; Application No. PCT/US2013/030671.

European Office Action dated Dec. 7, 2015; Application No. 13714075.2.

International Search Report & Written Opinion dated Jun. 24, 2013; Appln. No. PCT/US2013/030671.

* cited by examiner

FLAT FOLDABLE PACKAGING

FIELD OF THE INVENTION

The present disclosure relates to packaging for a container, methods of assembly, uses of the container, and methods of using the container.

BACKGROUND OF THE INVENTION

There have been many improvements in packaging, focusing on containers for display and/or containment of an article, such as consumer products. There have been a variety of container designs focused around simplifying packaging such that the packaging can provide the exterior and interior of the container once folded. But there remains a need to improve the packaging in such a way that assembly of the packaging is further simplified and the packaging is appealing to a consumer while allowing a smaller amount of material and processing to be used.

US 2013/0270133 discloses container which includes a tray insert for providing the container's structure and a tray cover for providing a decorative container exterior. The cover and insert are provided as two separate flat sheets. The cover and insert may be shipped and stored flat until folded to form the container. The publication discloses the tray may be used as either a box compartment or a lid, but not formed from the same continuous materials. The publication does not disclose how to form the container from a single continuous sheet or how to provide a decorative exterior from the same sheet that US 2013/0299566 discloses a continuous sheet that is formed into a container, including a base portion and side walls. The sheet is capable of being printed on and may be made of a single sheet. The sheet may be shipped and stored flat until folded to form the container. The publication does not disclose how to create a lid for the container formed from the same continuous sheet as the base portion.

Thus, there remains a need for containers which are formed from fewer materials, materials that may be shipped and stored flat until formed into the container. There remains a need for a container in which the lid is formed from the same material as the box compartment. There remains a need for the material of the container to be suitable for both the interior and the exterior.

Teachings of US 2013/0270133 and US 2013/0299566 may relate to the present teachings and both are incorporated by reference for all purposes.

SUMMARY OF THE INVENTION

The present disclosure relates to a container comprising: a base portion with a plurality of edges along its perimeter; a wall projecting orthogonally from each edge forming a plurality of walls; a lid portion which is distanced from and parallel to the base portion; wherein at least one wall is integrally connected to both the base portion and lid portion; and the container is formed from a blank which is initially flat with a plurality of fold lines.

The present disclosure relates to a container comprising: a generally rectangular base portion with a plurality of edges along its perimeter; a wall projecting orthogonally from each edge forming a plurality of walls; a generally rectangular lid portion which is distanced from and parallel to the base portion; a front lid flap integrally connected to the lid portion; and a base insert with the same general shape as the base portion; wherein at least one wall is integrally connected to both the base portion and lid portion; the container is formed from blank which is initially flat and may include an outer blank and at least one inner blank.

In some preferred embodiments, the container of the disclosure includes an exterior in which at least one surface of the blank may be exposed and at least one surface of the blank may be suitable for printing or placement of decorative material. In some preferred embodiments, the blank may include fold lines to form the base portion, the lid portion, and at least one of the walls. In some preferred embodiments the container may include a base insert which is in planar contact with the base portion. In some preferred embodiments, the container may include a closure aid to maintain the container in a closed configuration.

The disclosure further relates to a method for forming a container which includes folding a blank along a plurality of fold lines to form a plurality of walls which project orthogonally from a plurality of edges along the perimeter of the container's base portion; folding the blank along at least one fold line to form a lid portion; folding the blank along at least one fold line to form a front lid flap; and closing the container by placing the lid portion distanced from and parallel to the base portion and placing the front lid flap in planar contact with at least one wall.

Thus the container of the disclosure can be formed through a blank which may initially be flat to form both a box compartment and a lid. The blank of the container is able to shipped and stored flat until it is used to form the container. The blank includes a portion which may be folded into a lid but is not a separate piece.

DETAILED DESCRIPTION

Figure 1:
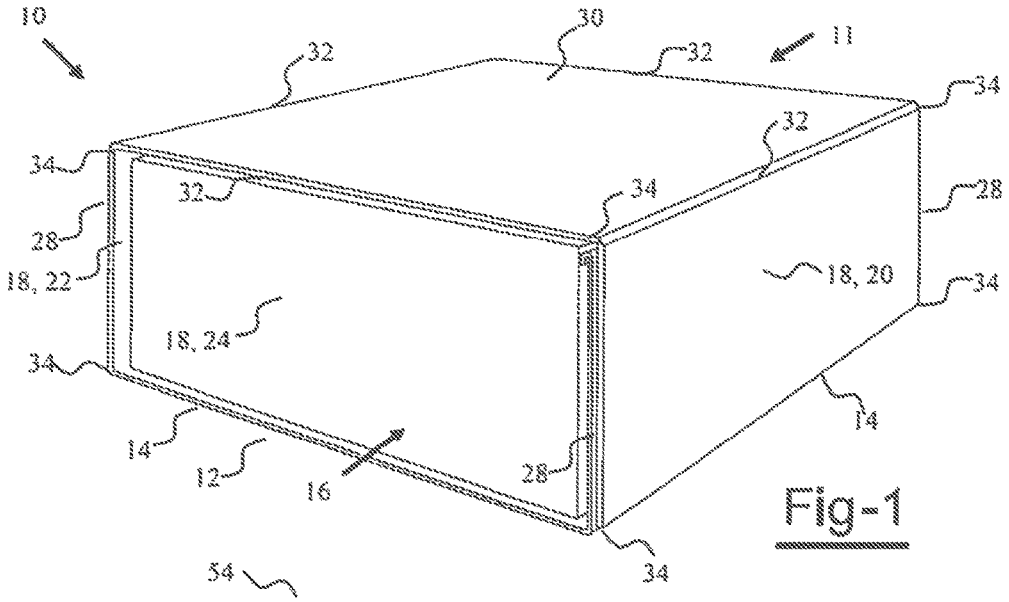
FIG. 1 is an isometric view of an illustrative container according to the teachings herein in its three-dimensional configuration.

The explanations and illustrations presented herein are intended to acquaint others skilled in the art with the invention, its principles, and its practical application. The specific embodiments of the present invention as set forth are not intended as being exhaustive or limiting of the invention. The scope of the invention should be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The disclosure relates to a container having both a first flat and one-dimensional configuration and a second three-dimensional configuration. The container may transition to and from the first configuration to the second configuration through folding and/or unfolding. The container may be used to hold and/or display an item(s) placed within it. The container may have an open position which provides access to the item(s) placed within it. The container may have a closed configuration to protect the item(s) within the container and/or limit or prevent access to the item.

The container according to the teachings herein may be configured to receive one or more items for retail purposes, for storage purposes, for transportation purposes, or any combination thereof. For example, the container may be configured for receiving an electronic device (such as a consumer electronic device), a cosmetic, a kit, an article of clothing, a housewares item, an automotive accessory, paper goods, a food item, or any combination thereof.

The disclosure relates to a container which comprises a base portion with a plurality of edges along its perimeter. The container further comprises a side wall projecting orthogonally from each edge thus forming a plurality of side walls. The container further comprises a lid portion which is distanced from and parallel to the base portion when the container is in a closed configuration. At least one side wall of the container is integrally connected to both the base portion and the lid portion. The container is formed from a blank which is initially flat and includes a plurality of fold lines.

The container of the disclosure may further comprise any one or more of the features described in this specification in any combination, including preferences and examples listed in this specification, and including the following features: both the base portion and the lid portion may have a generally rectangular shape; a front lid flap may be integrally connected to the lid portion and may be able to maintain the container in a closed configuration; the front lid flap may include a closure aid which may engage with a mating closure aid located on one of the walls of the container, such that a surface of the front lid flap is in planar contact with a surface of the wall; the container may comprise a base insert which may have the same general shape as the base portion, may be in planar contact with the base portion, and may be integrally connected to at least one wall of the container; the blank may comprise at least one inner blank which may be adhered to an outer blank; the outer blank may include fold lines which may form the base portion, the lid portion, and at least one of the walls; at least one inner blank may include fold lines which may form at least one of the side walls; at least one inner blank may include fold lines which may form the base insert; at least one inner blank may include cut-outs which may form a plurality of walls; the base insert may include a pull feature which may remove the base insert from planar contact with the base portion; the container may include an exterior, at least one surface of the blank may be exposed on the container's exterior, and the at least one surface may be suitable for printing or placement of decorative material; the container may be configured to receive an electronic device, a cosmetic, an article of clothing, a housewares item, an automotive accessory, a paper good, a food item, or any combination thereof; the container may include an exterior and at least one surface of the exterior may have a different texture than other surfaces of the container; at least a portion of the container may include a plurality of layers; the blank may comprise at least one inner blank which is attached to an outer blank with a blank attachment member; the blank attachment member may be a rotation member and the at least one inner blank, the outer blank, or both may be able to rotate about the rotation member; the at least one inner blank may include a first aperture and the outer blank may include a second aperture, the first aperture and the second aperture may receive the blank attachment member; the at least one inner blank and the outer blank may each have a longitudinal axis, the at least one inner blank's longitudinal axis may be parallel to the outer blank's longitudinal axis, and the at least one inner blank may be rotated about the rotation member so that its longitudinal axis may be perpendicular the outer blank's longitudinal axis; the blank may comprise at least one first inner blank which may be adhered to an outer blank and at least one second inner blank may be in direct planar contact with the at least one first inner blank; and the at least one second inner blank may be in direct planar contact with the at least one first inner blank on a surface directly opposing the surface of the at least one first inner blank adhered to the outer blank.

The container of the disclosure may comprise a base portion. The base portion may be substantially planar and generally rectangular. The base portion may include a plurality of edges along its perimeter. The base portion may include an inner facing surface and an exterior facing surface. The base portion may be of sufficient thickness to sustain the weight of the article placed within the container. The base portion may include a length and width. The length and the width may be sized such that the base portion is larger in length and width than the article placed within the container. The base portion may include one or more layers of one or more materials.

The container of the disclosure may comprise a lid portion. The lid portion may be substantially planar and generally rectangular. The lid portion may include a plurality of edges along its perimeter. The lid portion may include an inner facing surface and an exterior facing surface. The lid portion may have about the same overall size and shape as the base portion, such as having about the same length and about the same width. The lid portion may be integrally connected to all or part of the base portion. The lid portion may be made of the same material as all or part of the base portion. In the container's closed configuration, the lid portion may be distanced from and parallel to the base portion.

The container of the disclosure may comprise a plurality of side walls. Each side wall may have two lateral peripheral edges. The lateral peripheral edges of a side wall may be located at opposing edges of the side wall. The lateral peripheral edges of the side wall may be generally orthogonal to a peripheral edge of the base portion. Adjacent side walls may be connected along their lateral peripheral edges. Each side wall may have a height and a width. The side wall height may be sized such that the side walls are greater in height than the article placed within the box compartment. The side wall length may be the same as the length as the base portion's peripheral edge where the side wall meets the peripheral edge. The combination of the base portion and plurality of side walls may form the box compartment of the container in which a consumer article may be placed. At least one wall may be integrally connected to both the base portion and the lid portion. For example, the base portion, the lid portion, and at least one side wall may be made from a continuous material. When the container is closed, the plurality of walls may project orthogonally from the lid portion and the base portion.

The container of the disclosure may comprise a blank with a plurality of fold lines. The blank may initially be flat. The blank, prior to folding, may be considered the container's one-dimensional configuration. The blank may be folded along the fold lines to form the container's three-dimensional configuration. The blank may include an outer blank and at least one inner blank. The outer blank may include at least one exterior facing surface and at least one interior facing surface. The at least one inner blank may include at least one exterior facing surface and at least one interior facing surface. At least one of the inner blanks may be adhered to the outer blank. For example, a portion of the outer blank's interior facing surface may be adhered to a portion of an exterior facing surface of at least one inner blank. At least one of the inner blanks may have a width about the same as the height of at least one of the side walls. The outer blank may include the base portion, the lid portion, and at least one side wall. The at least one inner blank may include more than one side wall. The at least one inner blank may be made from the same material or a different material as the outer blank. If more than one inner blank is present, each inner blank may be made from the same or different material as other inner blanks.

The container of the disclosure may comprise one or more closure portions. One or more closure portions may be integrally connected to the lid portion. The one or more closure portions may share a peripheral edge with the lid portion. The one or more closure portions may maintain or aid in maintaining the container in a closed configuration. The one or more closure portions may be substantially planar and/or generally rectangular. One or more of the closure portions may have a similar size and shape as at least one of the side walls. The one or more closure portions may include an outer facing surface and an inner facing surface. The one or more closure portions may come in contact with the box compartment to form the container's closed configuration. For example, the inner facing surface of one or more closure portions may come into planar contact with an exterior facing surface of one or more side walls.

The container of the disclosure may comprise one or more closure aids. The closure aid may be located on one of the side walls of the container. For example, the closure aid may be located on an exterior facing surface of at least one side wall. The container may further comprise a second closure aid which mates with the first closure aid. The second closure aid may be located at an inward facing surface of at least one of the closure portions. The closure aids may be located such that when at least one of the closure portions come into planar contact with at least one of the side walls, the closure portions engage with another to maintain the contact between the side wall and the closure portion. The closure aid and mating closure aid may be any feature that keeps the container in the closed configuration, including hook and loop, such as Velcro®, magnets, a tab and an opening, and the like.

The container of the disclosure may further comprise a base insert. The base insert may have the same general shape as the base portion. The base insert may be substantially planar and generally rectangular. The base insert may have a length and width such that it fits inside the box compartment between the plurality of side walls. The baser insert portion may have an exterior facing surface and an inward facing surface. The exterior facing surface may be in planar contact with the base portion's inward facing surface. The base insert may be formed from the same or a different material than the base portion, lid portion, and/or the plurality of walls. The base insert may be part of the blank, it may be part of the outer blank, or part of an inner blank. Preferably, the base insert is part of an inner blank.

The blank for the container may include regions having creases, regions having slits, regions having perforations, or any combination thereof. Creases preferably are employed in areas that provide a structural feature, such as a connection between two adjacent walls or where at least one of the walls is integrally connected with other components, such as the lid portion and/or base portion. Creases are also preferably employed to all easy folding, defined folding, or both in regions that will be visible in the assembled container. Preferably, the assembled container is free of visible slits or perforations. Perforations and/or slits preferably are employed for folding in regions that are not visible in the assembled container and may not be required to provide a structure between the areas on either side of the fold. Creases, slits, perforations, and the combination thereof may be referred to as fold lines.

The container may include one or more side wall connection features capable of providing a connection between two ends or edges of the inner or outer blank to form a single side wall. Two edges or ends of the inner or outer blank may meet along the same plane and need a side wall connection feature to join the two edges to form a single side wall. The side wall feature is preferably located at the end or edge of the inner or outer blank with a corresponding side wall feature preferably located at an opposing end or edge of the inner or outer blank. Examples of side wall connection features that may be employed include cutouts, projections, magnets, adhesives, and/or the like. Preferably, a combination of cutouts and projections are employed.

The container may include one or more lateral projections that project from a lateral peripheral edge of a side wall layer. Such projections may be a tab or other feature capable of orienting in a direction so that it forms either part of or substantially a side wall, or more than one side wall. A projection may also form part or a substantial portion of the base insert. The lateral projection may provide reinforcement to a side wall and/or the base portion. The lateral projection may provide reinforcement for a corner.

The container may include one or more side wall connection features that are connected to two side wall layers of adjacent side walls (e.g., orthogonal side wall layers). Such side wall connection features may be a gusset or other feature capable of folding and/or orienting in a direction so that it forms part of one of the side walls, while maintaining a connection with an adjacent side wall. The gusset may provide reinforcement to a side wall. The gusset may provide support and or reinforcement for a corner. For example, a gusset may provide sufficient reinforcement for a container so that the corner does not tear during use. Preferably the gusset is of a sufficient size (e.g., length, width, or both) so that the walls of the corner are maintained in a generally upright orientation. A blank may include a sufficient number of gussets such that each of the corners is supported and/or reinforced by a gusset.

The container may include one or more side wall connection features capable of providing a connection between two adjacent side walls. The two adjacent side walls may meet at a corner and the side wall connection feature may provide strength or structural support to an edge of the container, orientation of the walls at an edge, or both. The side wall connection feature preferably is connected to at least one peripheral edge of a side wall layer. Examples of side wall connection features that may be employed include lateral projections (e.g., tabs), gussets, creases, or a combination. It will be appreciated that a side wall connection feature that is not connected to a side wall layer may also be employed. However, it is preferred that each side wall connection feature is connected to at least one side wall layer so as to minimize the material or components used to assemble the container.

The container may include an adhesive for attaching some or all of a face of a first surface to the face of a second surface. For example, adhesive may be employed for attaching two facing surfaces of the blank, such as a surface of the outer blank facing a surface of the inner blank. Adhesive may be employed for attaching an exterior surface layer to the outer blank. Adhesive may be employed for attaching a feature to the blank. For example, adhesive may be employed for attaching a pull feature to the base insert or attaching a closing feature to the closing flap and/or one of the side walls. The adhesive may be provided to one or both of the faces to be attached. The adhesive may be selected to provide a durable adhesion to the surfaces being attached. The adhesive may be characterized as a glue, a curable adhesive, a non-polar adhesive, a reactive adhesive, an adhesive that covalently bonds to a surface, an adhesive that bonds to a surface with van der Waals forces, or any combination thereof. The adhesive may be provided on the entirety of a surface or on a portion of a surface. For example, the adhesive may be provided as a pattern on a surface, as uniform layer, irregularly, along a periphery of a surface, or any combination thereof.

The container may include a blank attachment member. The blank attachment member may be any feature which may attach separate components or layers of the blank, such as affixing an inner blank to the outer blank. The blank attachment member may be any feature which provides for movement of a portion or layer of the blank. The blank attachment member may be a rotation member. For example, an inner blank may be affixed to the outer blank with a blank attachment member which allows the inner blank and/or the outer blank to rotate about the blank attachment member. By allowing the inner blank or outer blank to rotate, the portions or layers of the blank may be better aligned for occupying prior to being assembled into the container's three-dimensional configuration. For example, the inner blank may be aligned with the outer blank, such that its longitudinal axis parallel to the outer blank's longitudinal axis, thus occupying less storage space during shipment and/or storage of the blank. When the blank is ready to be assembled into the container's three-dimensional configuration, the inner blank may be rotated about the blank attachment member such that its longitudinal axis is perpendicular to the outer blank's longitudinal axis and in a position ready to form the three-dimensional configuration of the container. Examples of suitable blank attachment members may include: a brass fastener, a brad, a paper fastener, a split pin, a binding post, a rivet such as a brass rivet, a Chicago screw, eyelet, the like, or a combination thereof. The inner blank, outer blank, or both may include an aperture for receiving the blank attachment member. The aperture may have a diameter or cross-section of sufficient size to allow the inner blank, the outer blank, or both to rotate about the blank attachment member. For example, the aperture of the inner blank may have a cross-section or diameter larger than the rotation member to allow it to pivot or rotate about the rotation member. For example, the aperture of the outer blank may have a cross-section or diameter which creates a friction fit with the rotation member, such that the outer blank does not rotate about the rotation member. In the one-dimensional configuration, the inner blank may be placed onto or aligned with the outer blank such that their respective apertures are concentric.

At least one or more surfaces of the blank, including the inner blank and/or the outer blank may be adapted or printing directly on its surface. Preferably at least one of the exterior facing surfaces of either the inner blank or the outer blank is adapted for printing directly on its surface, more preferably at least one of the outer blank exterior facing surfaces is adapted for printing directly on its surface. When folded into a container, one or more portions of the show surface, such as the exposed exterior facing surface(s) of the inner and/or outer blank may be visible. When folded into a container, preferably none of the hidden surface is visible. Nevertheless, it may be advantageous to have printing on a hidden surface so that instructions or other features may be provided on that surface. It is also possible to fold a sheet and/or employ openings in a sheet so that portions of both faces are visible.

At least one or more surfaces of the blank, including the inner blank and/or the outer blank may have a surface with a different texture than other surfaces of the blank. The texture may provide the packaging with a unique feel or appearance. The texture may act as a visual or tactile cue for a consumer when deciding to purchase the article placed within the container. For example, the outer blank may have an exterior surface with a texture that is soft to the touch. The soft texture may feel comfortable in a consumer's hand. For example, the inner blank may include at least one surface with a smoother surface than other surfaces of the container. The smooth surface may better display the article placed within the packaging, by making the display more aesthetically appealing.

The blank may be formed of any material or combination of materials capable of being folded to form multiple layers of the container components, such as multiple layers of the walls, multiple layers of the base portion, or both.

The outer blank and at least one inner blank may each have a first face and a second face. The thickness of each blank is the distance between the two opposing faces. The thickness may be uniform or it may vary. Preferably each blank has a thickness that is sufficiently uniform so that it can be made from stock materials (e.g., card stock, sheet stock, cardboard) or other material having generally uniform materials. As used herein, a sheet having a uniform thickness has a thickness with a standard deviation of about 20% or less, about 10% or less, about 5% or less, or about 1% or less. For example, the standard deviation of the thickness may be about 0%.

The blank, including the outer blank and the one or more inner blanks, may be formed by die cutting a sheet stock material. As such, the blank, may be die cut preform for a container. Any material suitable for folding, die cutting, or both may be employed. The blank may be a single layered material or may have multiple layers. For example, the blank may include a layer of a polymer, a layer of a paper, a corrugated medium, or any combination. A particularly preferred material is a paperboard. Another particularly preferred material is cardboard. Any paperboard or cardboard may be employed. A combination of two or more materials may be employed. A preferred combination includes the outer blank formed by a cardboard and one or more inner blanks formed by a paperboard. Another preferred combination includes the outer blank formed by a cardboard, at least one inner blank formed by a cardboard, and at least on other blank formed by a paperboard. The inner and outer blanks may be comprised of the same material. An example of such is that both the outer blank and one or more inner blanks are formed by cardboard or paperboard. The thickness of the material is preferably about 0.5 mm to about 6 mm, and more preferably 0.8 mm to about 4 mm. The thickness of the material is preferably sufficiently high so that the container can be assembled without having to fold an excessive number of layers of the base portion. As an example, if the blank material includes a paperboard, the paperboard may be characterized as about 8 point, 10 point, about 12 point, about 14 point, about 16 point, about 18 point, about 20 point, about 22 point, about 24 point, or about 26 point, about 28 point, about 30 point, or about 32 point. As another example, if the blank material includes a cardboard, the cardboard may be characterized as single face board, single wall board, double wall board, or even triple wall board. If the blank material includes a cardboard, the cardboard may be characterized as C-Flute, B-Flute, E-Flute, F-Flute, or R-Flute.

The container may include any number of layers, base layers, wall layers, or both. For example, the base portion may include a plurality of base layers, one or more side walls (e.g., each side wall) may include a plurality of layers, or both. If a single layer may have insufficient strength to support the container, by using a plurality of stacked layers, a container having sufficient strength may be achieved. The number of base layers that form the base portion may be about 2 or more or about 3 or more. Preferably, the number of base layers is about 4 or more. The number of side wall layers that form a side wall may be about 2 or more or about 3 or more. Each side wall may have the same number of side wall layers or may differ in the number of side wall layers. Preferably, each side wall has the same number of side wall layers.

The components described in the teachings herein may be used for preparing a container having a generally polygonal base with n sides, where n is 3 or more. Containers that are employed having a box compartment often have n=4 sides. As such, the teachings focus on such containers, more particularly having rectangular bases. However, it should be appreciated the teachings herein can also be applied to containers having different number of sides, having one or more sides that is not parallel to another side, having an even number of sides, or having an odd number of sides, or having one or more sides with a length differing from one or all of the other sides, or any combination thereof. The base of the container may generally be thought of as being positioned on a horizontal plane. The base may be generally flat. However, the base may be formed to have minor amounts of curvature. The container generally has upright side walls rising vertically from the base portion. The height of the upright side walls will generally be uniform for a given upright side and constant between the upright side walls. However, containers in which one or more upright side walls vary in height and/or in which one or more side walls have a height that is different from the height of an opposing upright side wall may also be employed. By way of example, a container may include a generally rectangular base having four side walls, including a first side wall with a first height, an opposing side wall having a second height (e.g., greater than the first height), and adjacent side walls that vary in height (e.g., between the first height and the second height).

The disclosure further relates to a method of forming the container according to the teachings herein. The method may comprise: folding a blank along a plurality of fold lines to form a plurality of walls which project orthogonally from a plurality of edges along a perimeter of the container's base portion, folding a blank along at least one fold line to form a lid portion which is distanced from a parallel to the base portion, folding a blank along at least one fold line to form a front lid flap, and closing the container.

The method of forming the container may further comprise one or more of the following steps: the step of closing the container may include engaging a closure aid; a box compartment may be formed from folding the blank to form a plurality of walls; forming the container may include a step of folding the blank along at least one fold line to form a base insert which may lie in planar contact with the base portion within the box compartment; and forming the container may include a step of rotating a portion of the blank about a rotation member.

FIG. 1 is an isometric view of an illustrative container 10 in a three-dimensional and closed configuration 11 showing features of a container according to the teachings herein. The container 10 may include a base portion 12 that is generally polygonal in shape. For example, the base portion 12 may have a generally rectangular shape. The base portion may have peripheral edges 14. For example, the perimeter of the base portion 12 may be defined by the peripheral edges 14. The container may comprise a box compartment 16, defined by the base portion 12 and a plurality of side walls 18 extending from the peripheral edges. The container 10 may comprise a first pair of side walls 20, 22; a second pair of side walls 24, 26 (26 not shown); or both. A pair of side walls may be spaced apart, parallel, have the same length, or any combination thereof. Preferably, a pair of side walls are spaced apart, parallel, and have the same length (e.g, in the same direction of the peripheral edge 14 of the base portion 12 where the side wall and the base portion form an edge of the container 10). The first pair of side walls 20, 22 may include the front side wall 20 and the rear side wall 22. The container 10 may include lateral side wall edges 28 where two adjacent side walls 18 meet. Preferably, the side walls 18 are oriented orthogonally to the base portion 12. The container 10 may include a lid portion 30 that is generally polygonal in shape. The lid portion 30 may have a generally rectangular shape. The lid portion 30 may have the same general shape and/or size as the base portion 12. In the closed configuration 11, the lid portion 30 may be distanced apart and/or parallel to the base portion 12. Preferably in the closed configuration 11, the lid portion 30 is distanced apart and parallel to the base portion 12. The lid portion may have peripheral edges 32. Preferably, the side walls 18 are oriented orthogonally to the lid portion 30. The container 10 may include corners 34 (e.g., 4 or 8 corners) where the side walls 18 and the base portion 12 meet and where the side walls 18 and the lid portion 30 meet.

Figure 2:
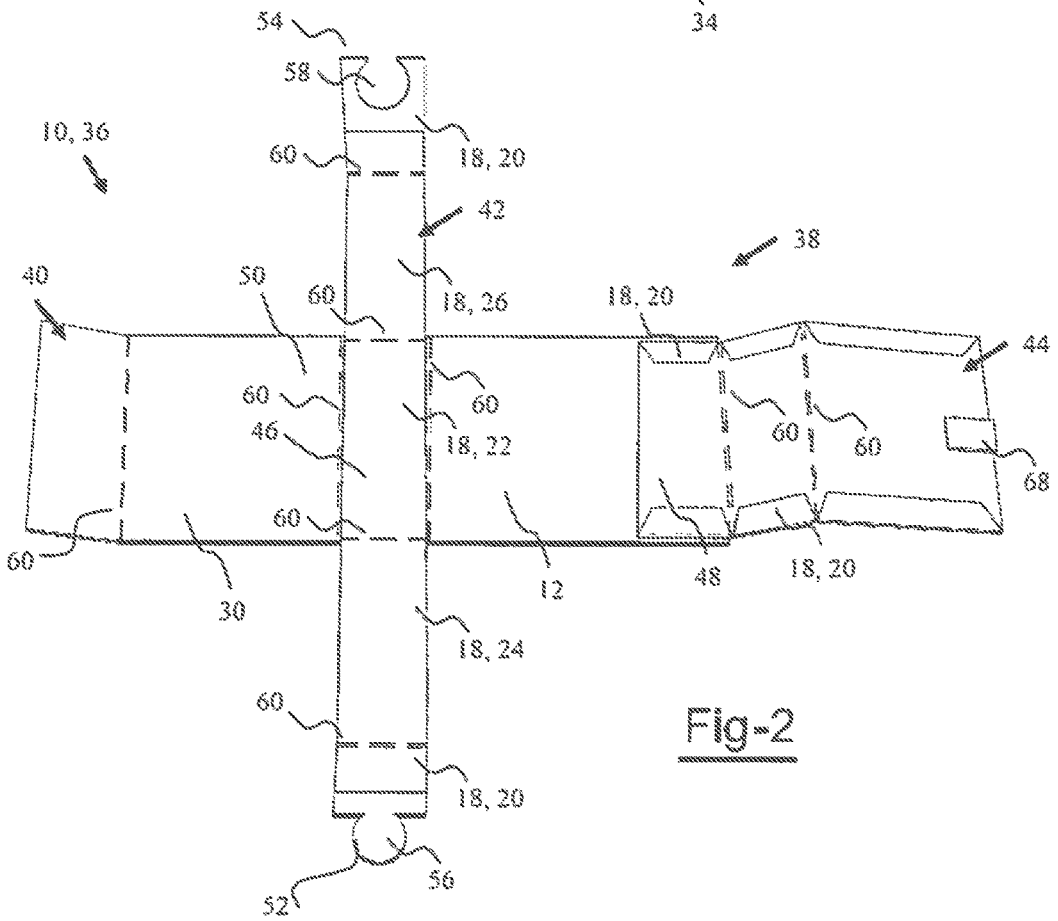
FIG. 2 is a plan view of an illustrative blank according to the teachings herein.

FIG. 2 is a plan view of an illustrative blank 36 to form an illustrative container 10 according to the teachings herein. The blank 36 may initially be flat. When flat, the blank 36 may be the one-dimensional configuration 38 of the container 10. The blank 36 may include an outer blank 40 and at least one inner blank 42, 44. For example, the blank 36 may include a first inner blank 42 and a second inner blank 44. The first inner blank 42 may have a width about the same as the height of the container's 10 side walls. The inner blank 42, 44 may have an outward facing surface 46, 48 which is at least partially adhered to an inward facing surface 50 of the outer blank 40. The first inner blank 42 may be adhered to the outer blank 40 such that the first inner blank 42 and outer blank 40 lie in a substantially same plane and are about perpendicular in another plane. The second inner blank 44 may be adhered to the outer blank 40 such that the second inner blank 44 and outer blank 40 lie in the substantially same planes. At least one of the inner blanks 42, 44 may include connection features 52, 55 to form at least one of the side walls 18. For example, the first inner blank 42 may comprise a first end 52 and a second end 54. The first end 52 and second end 54 may include mating features 56, 58, such as the first end 52 including a projection 56 that mates with a cut-out 58 at the second end 54. The blank 36 may include a plurality of fold-lines 60 to aid in defining how to fold the blank 36 to form the container 10. The blank 36 may include a pull feature 68 to aid in assembling or disassembling the container 10. For example, the blank 36 may include a pull feature 68 to aid in placing and/or lifting of the base insert 62 from within the box compartment 16. For example, the second inner blank 44 may include a tab or loop 68 located where an edge of the base insert 62 is adjacent to a side wall 18, such as where the an edge of the base insert 62 is adjacent to the rear side wall 22.

Figure 3:
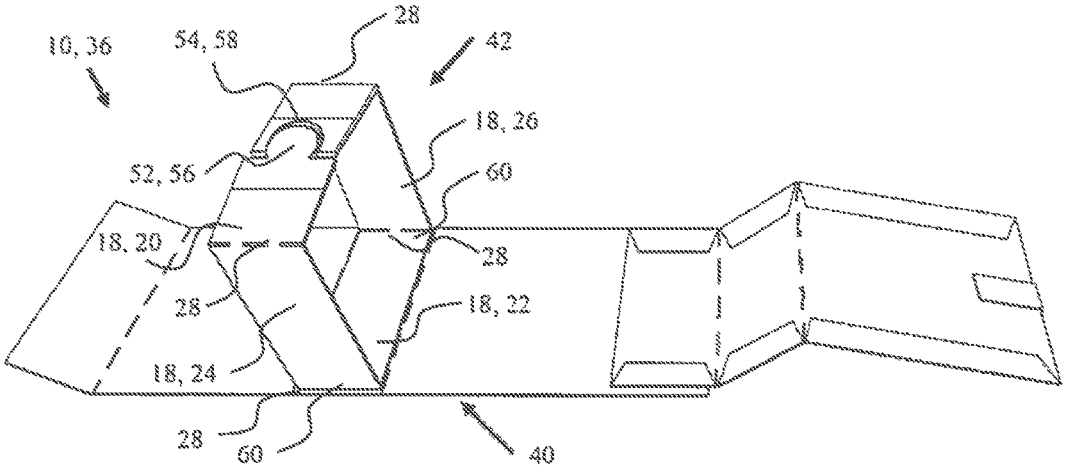
FIG. 3 is an isometric view of an illustrative container being formed from a blank according to the teachings herein.

FIG. 3 is an isometric view of an illustrative blank 36 forming the three-dimensional configuration 11 of an illustrative container 10 according to the teachings herein. The first inner blank 42 may be folded at fold lines 60 located at the lateral edges 28 of a side wall 18, such as the lateral edges of the rear side wall 22. By folding the first inner blank 42, a substantial plurality of the side walls 18 may be formed. To form another side wall 18, such as the front side wall 20, the first inner blank 42 may be folded at fold lines 60 located at lateral edges 28 of a side wall 18, such as the lateral edges of the front side wall 20. By folding at these lateral edges 28, the first end 52 of the first inner blank 42 may connect with the second end 54 of the first inner blank 42 to form the plurality of side walls 18. For example, the projection 56 at the first end 52 of the first inner blank 42 may matingly connect with the cut-out 58 at the second end 54 of the first inner blank 40.

Figure 4:
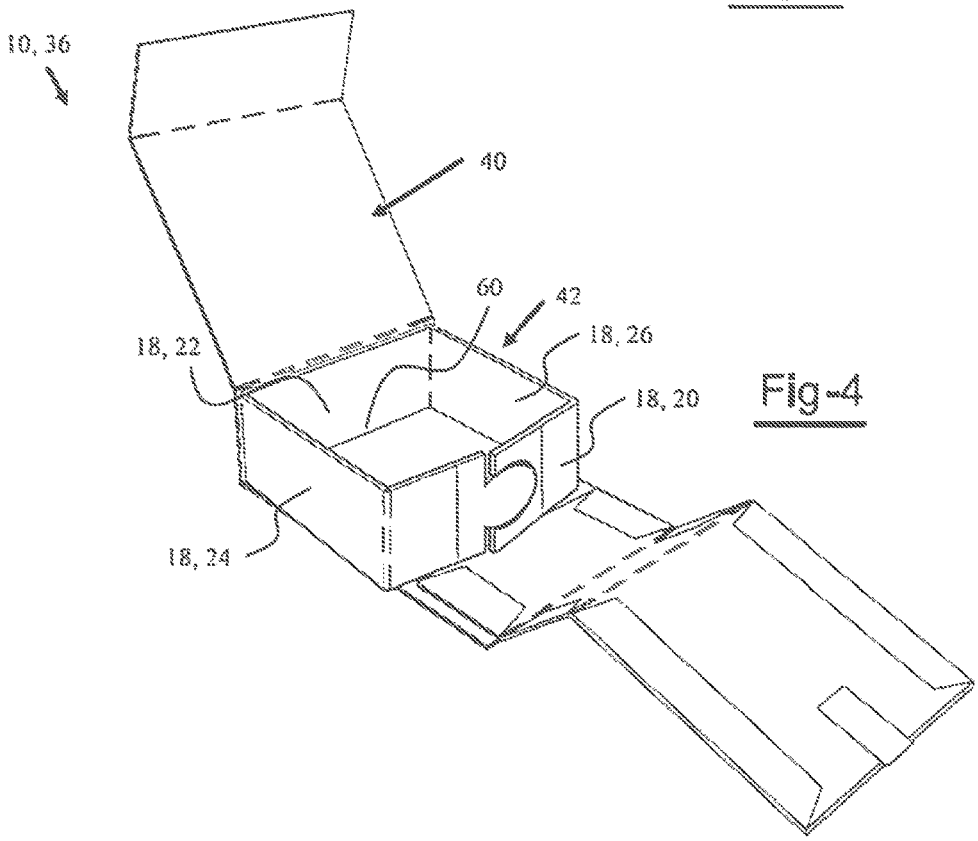
FIG. 4 is an isometric view of an illustrative container being formed from a blank according to the teachings herein.

FIG. 4 is an isometric view of an illustrative blank 36 forming the three dimensional configuration 11 of an illustrative container 10 according to the teachings herein. The blank 36 may be folded along a fold line 60 such that the plurality of walls 18 project orthogonally from the peripheral edges 14 of the base portion 12. An example of such is to fold the blank 36 where the base portion 12 meets a side wall 18, such as where the base portion 18 meets the rear side wall 22.

Figure 5:
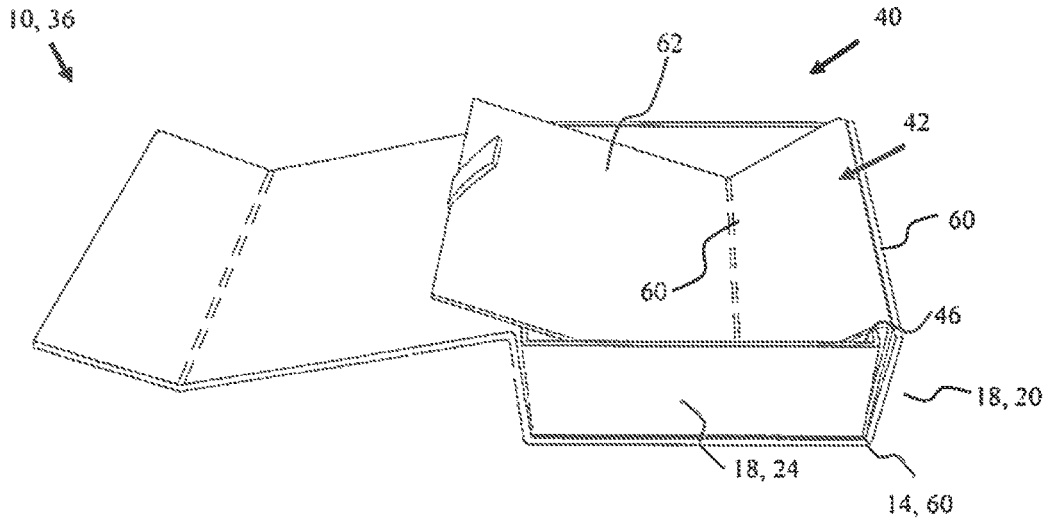
FIG. 5 is an isometric view of an illustrative container being formed from a blank according to the teachings herein.

FIG. 5 is an isometric view of an illustrative blank 36 forming a three-dimensional configuration 11 of an illustrative container 10 according to the teachings herein. The blank 36 may be folded along a fold line 60 such as to create multiple layers along portions of the container 10, such as multiple layers at a side wall 18. An example of such is to fold the blank 36 where the base portion 12 meets a side wall 18 at a base portion's 12 peripheral edge 14, such as where the base portion 12 meets the front side wall 20. The blank 36 may then be folded again to create another layer at the side wall 18, such as folding the second inner blank 42 at the front side wall 20 such that it comes into planar contact with the interior facing surface 46 of the front side wall 20. Also illustrated is a base insert 62.

Figure 6:
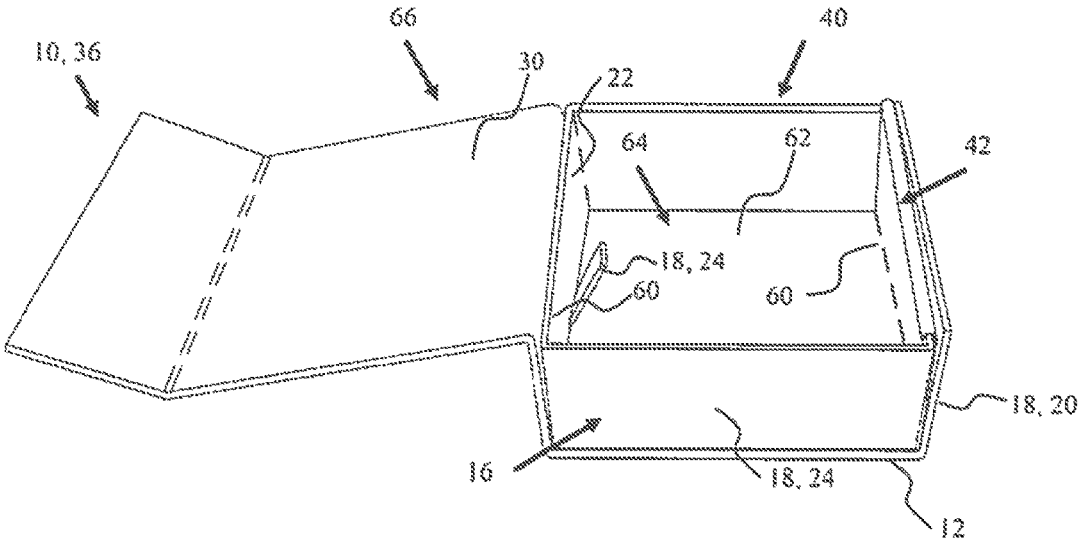
FIG. 6 is an isometric view of an illustrative container being formed from a blank according to the teachings herein.

FIG. 6 is an isometric view of an illustrative blank 36 forming a three-dimensional configuration 11 of a container 10 according to the teachings herein. The blank 36 may be folded along a fold line 60 to crease a base insert 62 and/or multiple layers at the base portion 12. For example the blank 36, such an the inner blank 44, may be folded along a fold line 60 located where a side wall 18 meets the base portion 12 within the interior of the box compartment, such as where the front side wall 20 meets the base portion 12 within the box compartment 16 interior 64. The base insert 62 of the blank 36 may then be folded down until it is in planar contact with the inward facing surface 50 (not shown) of the base portion 12. When the plurality of side walls 18 have been formed and are orthogonal to the base portion 12 and the base insert 62 has been folded into the box compartment 16 interior 64, the open configuration 66 of the container 10 may be formed. The container 10 may then be closed into the closed configuration 11. For example, the lid portion 30 of the container 10 may then be folded at the fold line 60 located where a side wall 18 meets the lid portion 30, such as a fold line 60 located where the rear side wall 22 meets the lid portion 30 to close off the box compartment 16 of the container 10.

Figure 7:
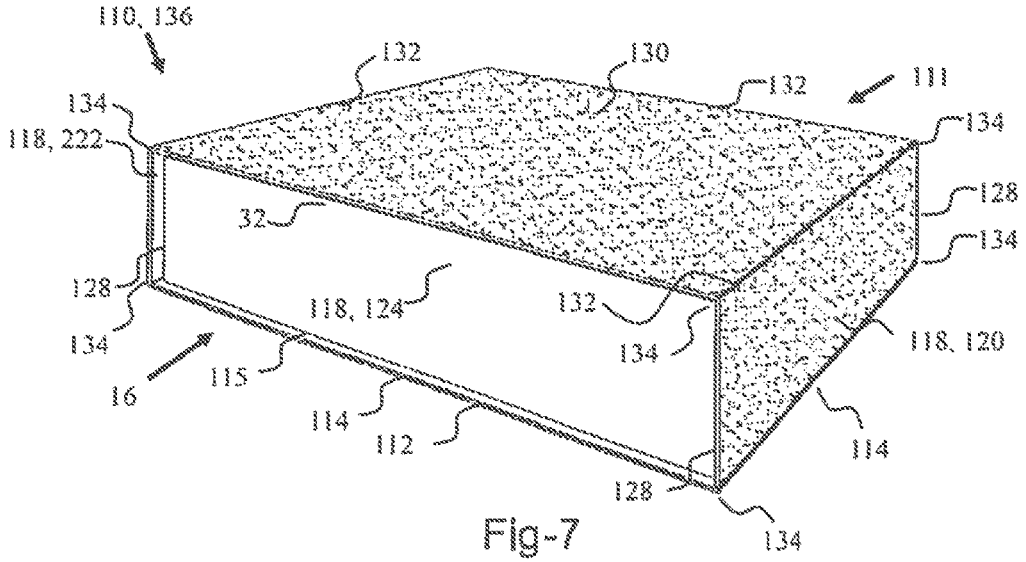
FIG. 7 is an isometric view of an illustrative container according to the teachings herein in its three-dimensional configuration.

FIG. 7 is an isometric view of an illustrative container 110 in a closed configuration 111 according to the teachings herein. The container 110 may include a base portion 112 that is generally polygonal in shape. For example, the base portion 112 may have a generally rectangular shape. The base portion 112 may have a plurality of layers. The base portion 112 may have a plurality of edges 114, 115. If the base portion 112 is made of a plurality of layers, each layer may comprise a plurality of edges 114, 115. One layer of the base portion's 112 outer edges 115 may be distanced from or flush with the plurality of edges 114 of another layer of the base portion 112. The container 110 may include a plurality of side walls 118 that may extend from peripheral edges 114, 115 of the base portion. The container 110 may include a first pair of side walls 120, 122, a second pair of side walls 124, 126, or both. A pair of side walls 118 may be spaced apart, parallel, have the same length, or any combination thereof. Preferably, a pair of side walls 118 are spaced apart, parallel, and the same length (e.g., in the direction of the peripheral edge of the base portion where the side wall and the base portion form an edge of the container). The container 110 may include lateral side wall edges 128 where two adjacent side walls 118 meet. The container may include on or more side wall connection features (not shown) that connect two side walls. Preferably, the side walls 118 are oriented generally orthogonally to the base portion 112. The combination of the side walls 118 with the base portion 112 comprise may comprise a box compartment 116 of the container 110. The container 110 may further include a lid portion 130. The lid portion 130 may be generally polygonal in shape. For example, the lid portion 130 may have a generally rectangular shape. The lid portion 130 may have the same shape as the base portion 112. When the container 110 is in the closed configuration 111, the lid portion 130 may be distanced from and parallel to the base portion 112. When the container 110 is in the closed configuration 111, the side walls 118 may be oriented generally orthogonally from both the base portion 112 and the lid portion 130. The lid portion may have peripheral edges 32. The container may 110 include corners 134 (e.g. four to eight corners) where two side walls 118 and the base portion 112 meet and/or where two side walls 118 and the lid portion 130 meet. The container 110 may include a lid flap portion 131. The lid flap portion 131 may be integrally connected with the lid portion 130. The lid flap portion 131 may have approximately the same height as the side walls 118. In the container's 110 closed configuration 111, the lid flap portion 130 may be in substantially planar contact with a side wall 118, such as the front side wall 120.

Figure 8:
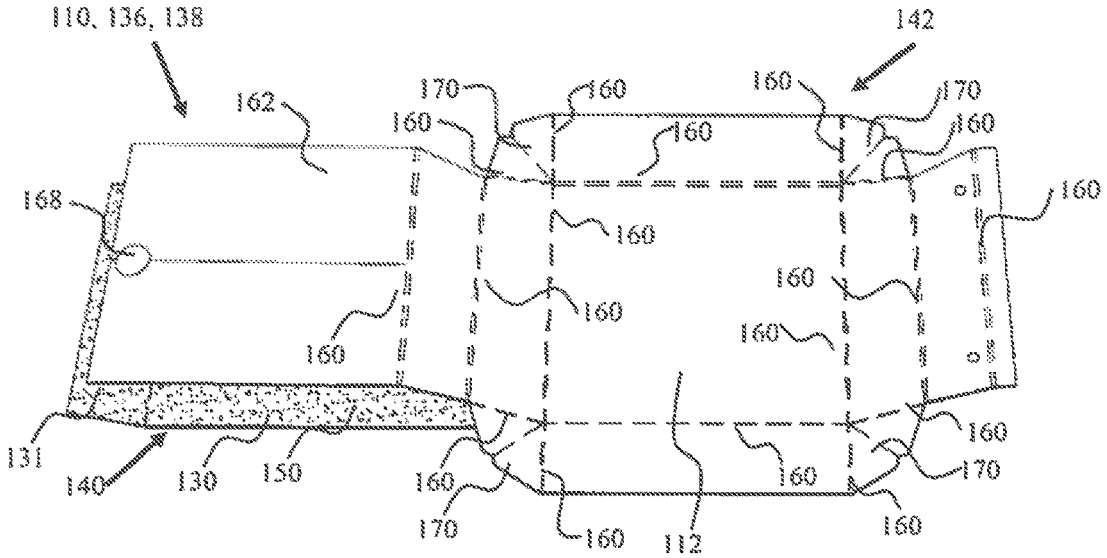
FIG. 8 is a plan view of an illustrative blank according to the teachings herein.

FIG. 8 is a plan view of an illustrative blank 136 for forming an illustrative container 110 of the teachings herein. The blank 136 may initially be flat. The blank 136 may be the container's 110 one-dimensional configuration 138. The blank 136 may include both an outer blank 140 and at least one inner blank 142. The blank 136 may include a plurality of fold lines 160. The fold lines 160 may be used to guide folding of the blank 136 to form the three-dimensional configuration of the container 117. At least a portion of the inner blank 142 may be adhered to the outer blank 140 and form a plurality of layers. For example, an outer facing surface 146 (not shown) of the inner blank's 142 base portion 112 may be adhered to the inner facing surface 150 of the outer blank's 140 base portion 112 and thus may form at least two layers at the base portion 112. The inner blank 142 may include the base portion 112, at least one side wall 118, a base insert 162, a base insert pull tab 168, a plurality of fold lines 160, and/or at least one connecting feature 170 to connect the side walls 118 at the side wall lateral edges 128. Preferably, the inner blank 142 includes the base portion 112, at least one side wall 118, a base insert 162, a base insert pull tab 168, a plurality of fold lines 160, and at least one connecting feature 170 to connect the side walls 118 at the side wall lateral edges 128. The blank 136 may include fold lines 160 along the plurality of the base portion's 112 peripheral edges 114, 115 to guide the formation of at least one side wall 118. For example, the inner blank 142 may include fold lines 160 at the peripheral edges 115 of the inner blank 142 base portion 112. The blank 136 may include connection features 170 to guide the folding of the side walls 118 and aid in connecting of the side walls 118 at their lateral side edges 128. For example, the inner blank 146 may include gussets 170 integrally connected to the side wall 118 lateral edges 128. The outer blank 140 may include the base portion 112, at least one side wall 118, the lid portion 130, and the front lid flap 131. For example, the outer blank 140 may include the base portion 112, the rear side wall 122, the lid portion 130, and the front lid flap 131.

Figure 9:
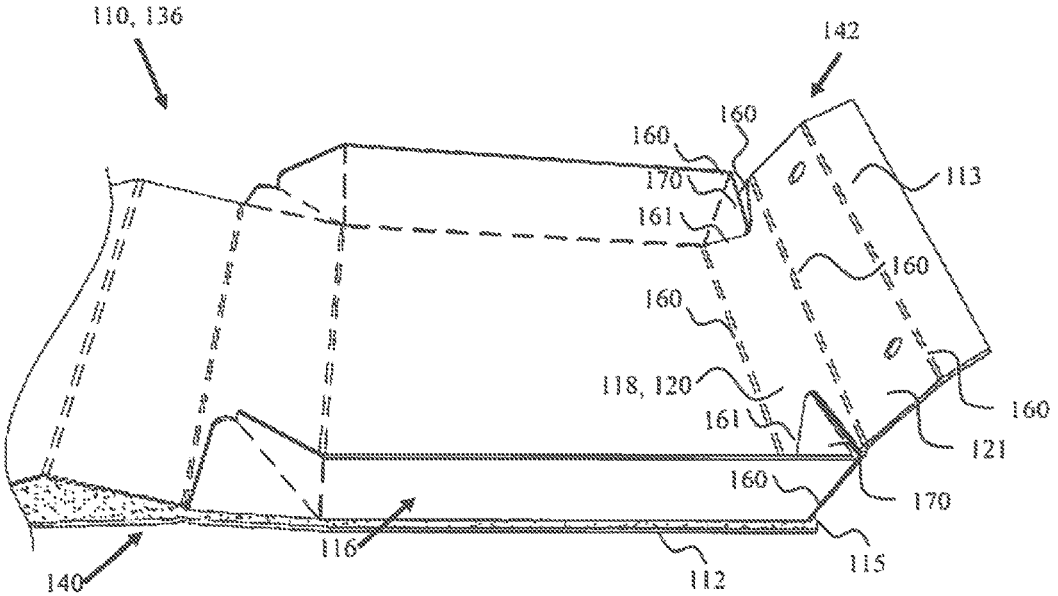
FIG. 9 is an isometric view of an illustrative container being formed from a blank according to the teachings herein.

FIG. 9 is an isometric view of an illustrative blank 136 forming an illustrative container 110 of the teachings herein. The blank 136 may be able to be folded along a fold line 160 to form at least one of the side walls 118. For example, the inner blank 142 may be able to fold at a fold line 160 located at its peripheral edge 115 where the front side wall 120 meets the inner blank 142 base portion 112. The gussets 170 located at the lateral side edges 128 of the front side wall 120 may include creases 161 and/or perforations that guide the gusset 170 inward to the inside of the container's 110 box compartment 116 when the front side wall 120 is transitioned from the one-dimensional configuration to the three-dimensional configuration 117 (not shown) in which the front side wall 120 is orthogonal to the base portion 112. Upon folding the front side wall 120 such that it is orthogonal, the gussets 170 may be in planar contact with the inward facing surface of a side wall 118, such as the front side wall 120, and thus may become part of the side wall 118, 120. Also illustrated is a second front side wall layer 121 and a folding lip 113.

Figure 10:
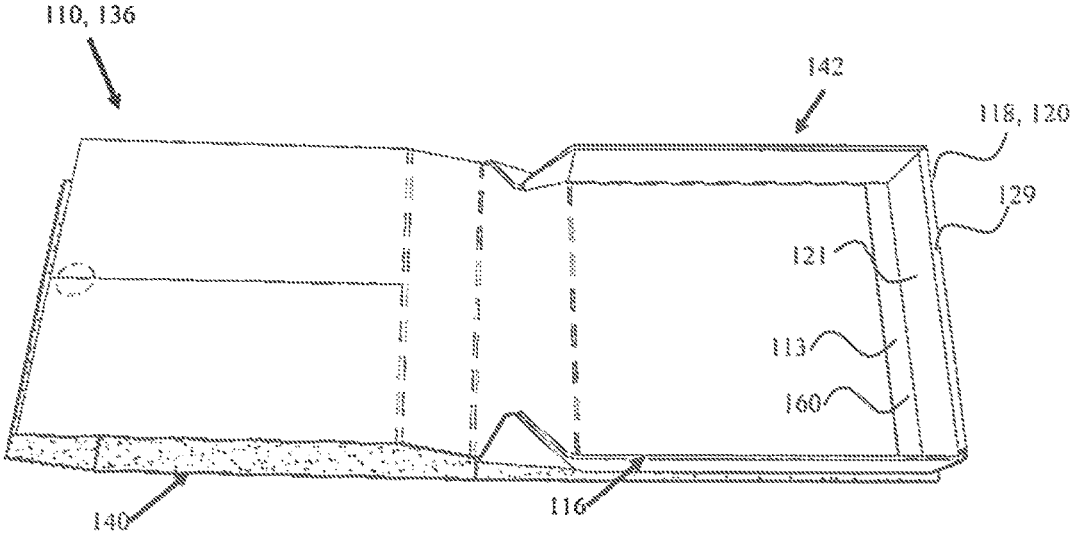
FIG. 10 is an isometric view of an illustrative container being formed from a blank according to the teachings herein.

FIG. 10 is an isometric view of an illustrative blank 136 forming an illustrative container 110 of the teachings herein. The inner blank 136 may include a second front side wall layer 121 that is integrally connected with the front side wall 120. The inner blank 136 may include a fold line 160 (as shown in FIG. 9) at the front side wall 120 edge 129 opposite the where the side wall 118 meets the base portion 112. For example, the inner blank 136 may be folded along the second front side wall 121 fold line 160 located at the front side wall 120 edge 129 such that the second front side wall 121 is in planar contact with the front wall 120 surface which faces inward toward the box compartment 116. The second front side wall 121 may include a folding lip 121 that may fold at a fold line 160 of the inner blank 142 to be in planar contact with the base portion's 112 inside of the box compartment 116.

Figure 11:
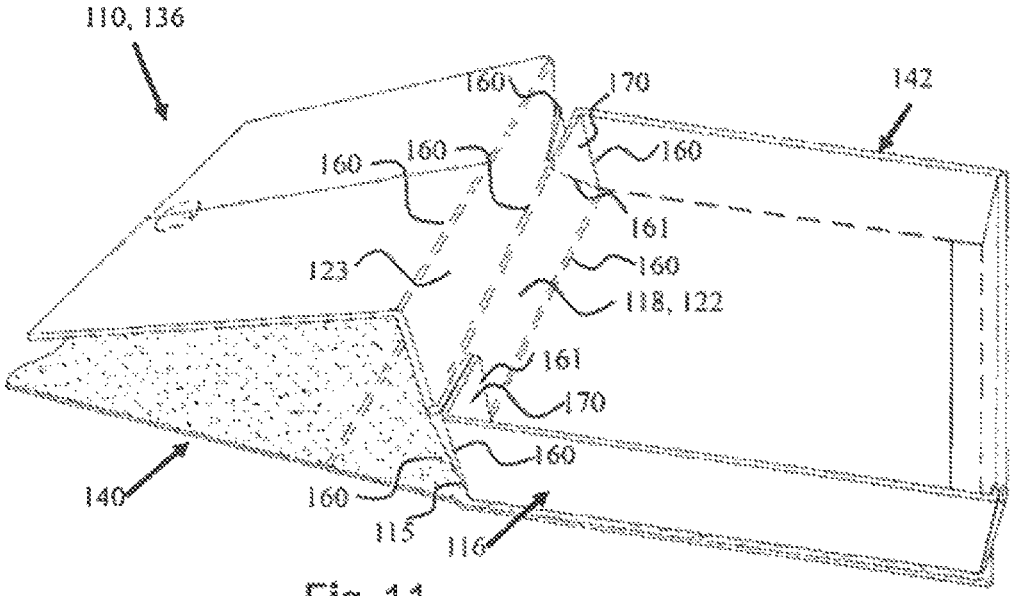
FIG. 11 is an isometric view of an illustrative container being formed from a blank according to the teachings herein.

FIG. 11 is an isometric view of an illustrative blank 130 forming an illustrative container 110 of the teachings herein. The inner blank 142 may include a fold line 160 along which it may be folded to form at least another side wall 118. For example, the inner blank 142 may be able to fold at a fold line 160 located at its peripheral edge 115 where the rear side wall 122 meets the inner blank 142 base portion 112. The gussets 170 located at the lateral side edges 128 of the rear side wall 122 may include creases 161 and/or perforations that guide the gusset 170 inward to the inside of the container's 110 box compartment 116 when the rear side wall 122 is transitioned from the one-dimensional configuration to the three-dimensional configuration in which the rear side wall 122 is orthogonal to the base portion 112. Upon folding the rear side wall 122 such that it is orthogonal, the gussets 170 may be in planar contact with the inward facing surface of a side wall 118, such as the rear side wall 122, and thus may become part of the side wall 118, 122. Also illustrated is a second rear side wall layer 123.

Figure 12:
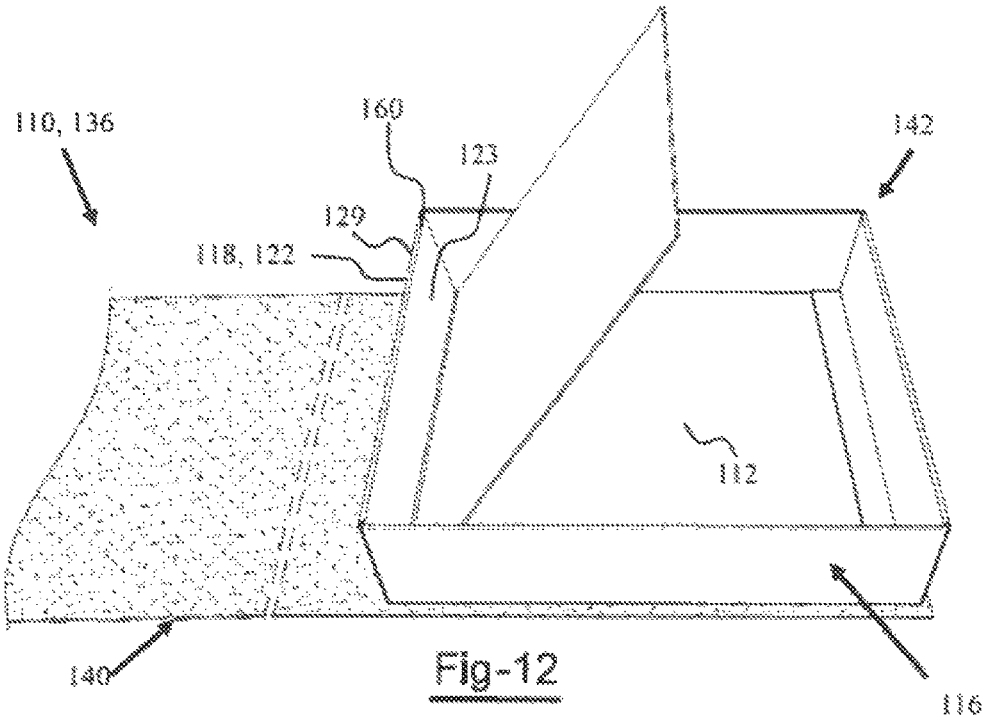
FIG. 12 is an isometric view of an illustrative container being formed from a blank according to the teachings herein.

FIG. 12 is an isometric view of an illustrative blank 136 forming an illustrative container 110 of the teachings herein. The inner blank 142 may include a second rear side wall layer 123 that is integrally connected with the rear side wall 122. The inner blank 142 may include a fold line 160 (as shown in FIG. 11) at the rear side wall 122 edge 129 opposite the edge where the side wall 118, 122 meets the base portion 112. The inner blank 142 may be folded along the second rear side wall 123 fold line 160 resulting in the second rear side wall layer 123 being in planar contact with the rear side wall 122 on the rear side wall 122 surface facing inward toward the box compartment 116.

Figure 13:
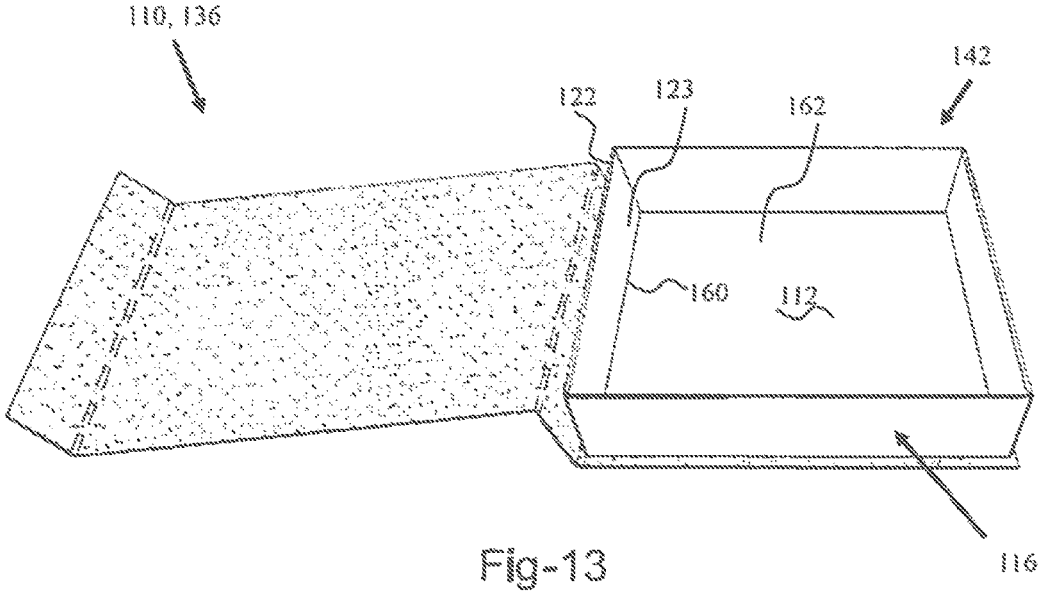
FIG. 13 is an isometric view of an illustrative container being formed from a blank according to the teachings herein.

FIG. 13 is an isometric view of an illustrative blank 136 forming an illustrative container 110 of the teachings herein. The inner blank 142 may include a base insert 162. The base insert 162 may be integrally connected with at least one side wall 118 of the container, such as the rear side wall 122, 123, such as the second rear side wall layer 123. The inner blank 142 may include a fold line 160 (as shown in FIG. 10) to guide placement of the base insert 162. For example, a fold line 160 may be located at the second side wall layer 123 is in contact with the base portion 112 when the container 110 when the box compartment 116 has been formed. The blank 136 may then be folded such that the base insert 162 is located within the box compartment 116, such as by folding the inner blank 142 such that a surface of the base insert 162 is in planar contact with a surface of the base portion 112 which faces inward toward the box compartment 116. The base insert 162 may be in planar contact with the folding lip 113 (not shown). The base insert 162 may be sized such that it is substantially planar and/or generally rectangular. The base insert 162 may be sized such that it has a surface area sufficient to cover the inner facing surface of the base portion 112. The blank 136 may include a pull feature 168 (as shown in FIG. 6 and FIG. 8) to aid in placing and/or lifting of the base insert 162 from within the box compartment 116. For example, the inner blank 142 may include a tab or loop located where an edge of the base insert 162 is adjacent to a side wall 118, such as where the an edge of the base insert 162 is adjacent to the front side wall 120, 121.

Figure 14:
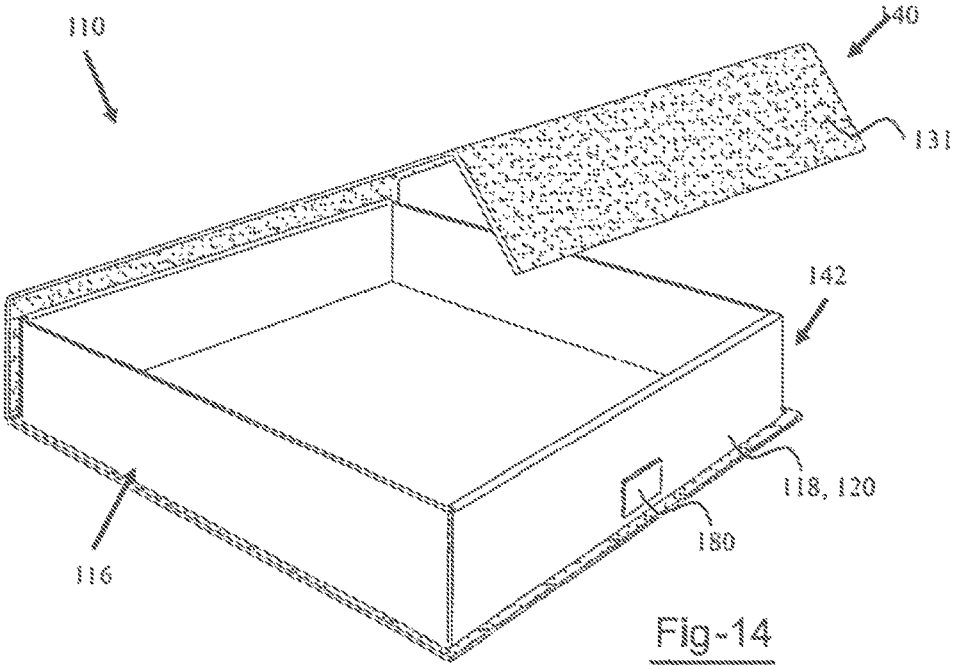
FIG. 14 is an isometric view of an illustrative container being formed from a blank according to the teachings herein.

FIG. 14 is an isometric view of an illustrative container 110 of the teachings herein. The container may include at least one closure aid 180 to aid in maintaining the container 110 in the closed configuration 111 (not shown). A side wall 118 and/or the front lid flap 131 of the container 110 may include a closure aid 180 and/or a mating closure aid (not shown). For example, a side wall 118, such as the front side wall 120, may include a connecting feature 180 such as Velcro® or a magnet on its outward facing surface. The connecting feature 180 may also be embedded in between material layers of the front lid flap 131 and/or side wall 118 such that it is no visible. The lid portion 131 may include a matching or mating corresponding connecting feature (see FIGS. 1 and 7) on the surface that faces inward toward the box compartment 116 when the container 110 is closed 111 (see FIGS. 1 and 7). In the closed configuration 111 (see FIGS. 1 and 7), the two closure aids may be in direct contact with one another and thus are engaged with one another to maintain the closed configuration (see FIGS. 1 and 7) of the container.

Figure 15:
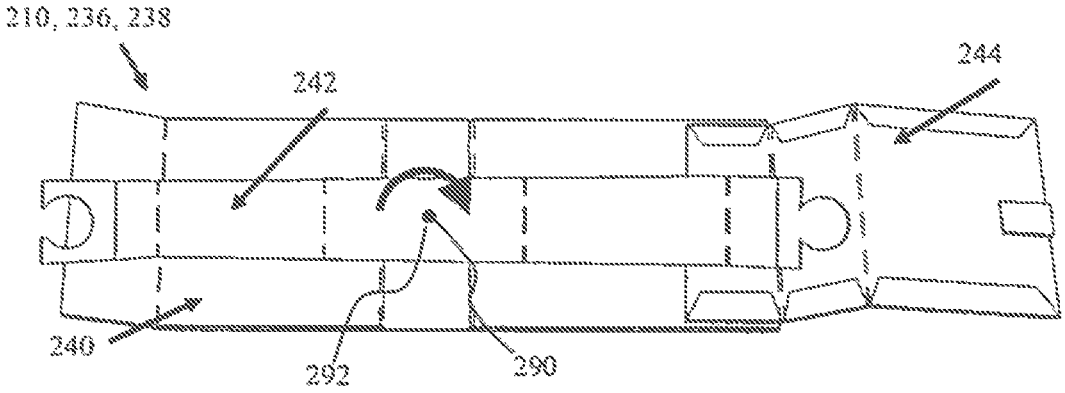
FIG. 15 is a plan view of an illustrative blank according to the teachings herein.

FIG. 15 is a plan view of an illustrative blank 236 to form an illustrative container 210 according to the teachings herein. The blank 236 may initially be flat. When flat, the blank 236 may be the one-dimensional configuration 238 of the container 210. The blank 236 may include an outer blank 240 and at least one inner blank 242, 244. For example, the blank 236 may include a first inner blank 242 and a second inner blank 244. The first inner blank 242 may have a width about the same as the height of the container's 210 side walls. The inner blank 242, 244 may be at least partially adhered or otherwise attached to the outer blank 240. For example, the second inner blank 244 may be adhered to the outer blank 240 such that the second inner blank 244 and outer blank 240 lie in substantially the same planes. The first outer blank 242 may be attached to the outer blank 240 such that the first inner blank 242 and the outer blank 240 lie in substantially the same planes and their respective longitudinal axis are parallel to one another. The first inner blank 242 may be attached to the outer blank 242 with a rotation member 290. The rotation member 290 may allow for the first inner blank 242 to rotate about the rotation member 290. The first inner blank 242 may include an opening 292 to receive the rotation member 290. The outer blank may include an opening (not shown) to receive the rotation member 290.

Figure 16:
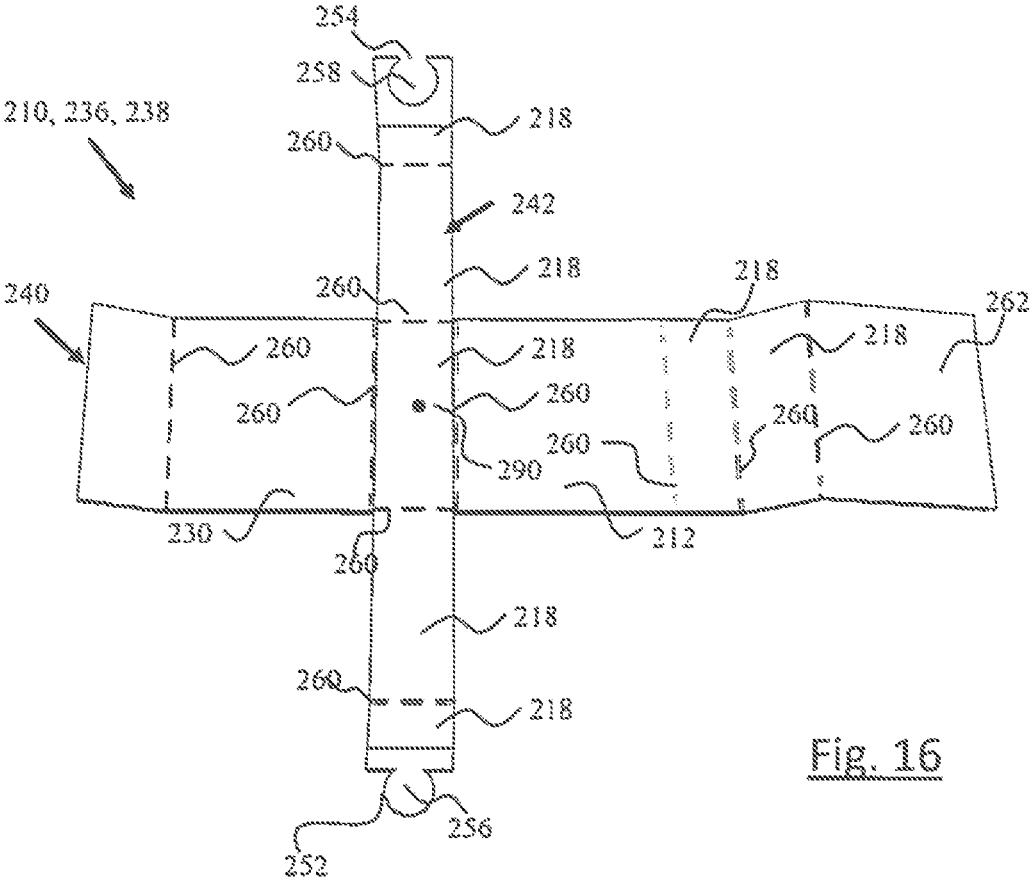
FIG. 16 is a plan view of an illustrative blank according to the teachings herein.

FIG. 16 is a plan view of an illustrative blank 236 to form an illustrative container 210 according to the teachings herein. The blank 236 may initially be flat. When flat, the blank 236 may be the one-dimensional configuration 238 of the container 210. The blank 236 may include an outer blank 240 and at least one inner blank 242. The inner blank 242 may have a width about the same as the height of the container's 210 side walls 218. The inner blank 242 may be rotated about a rotation member 290 to be in a position suitable for forming the container's 210 three-dimensional configuration (not shown). For example, the inner blank 242 may be rotated about the rotation member 290 such that it lies in substantially the same plane as one of the planes of the outer blank 240 and its longitudinal axis is perpendicular to the outer blank's 240 longitudinal axis. For further example, the inner blank 242 may be rotated about 90 degrees clockwise or counterclockwise about the rotation member 290. The inner blank 242 may include connection features 256, 258 to form at least one of the side walls 218. For example, the inner blank 242 may comprise a first end 252 and a second end 254. The first end 252 and second end 254 may include mating features 256, 258, such as the first end 252 including a projection 256 that mates with a cut-out 258 at the second end 254. The blank 236 may include a plurality of fold-lines 260 to aid in defining how to fold the blank 236 to form the container 210 and to define the side walls 218, the base portion 212, the lid portion 230, and the base insert 262.

Figure 17:
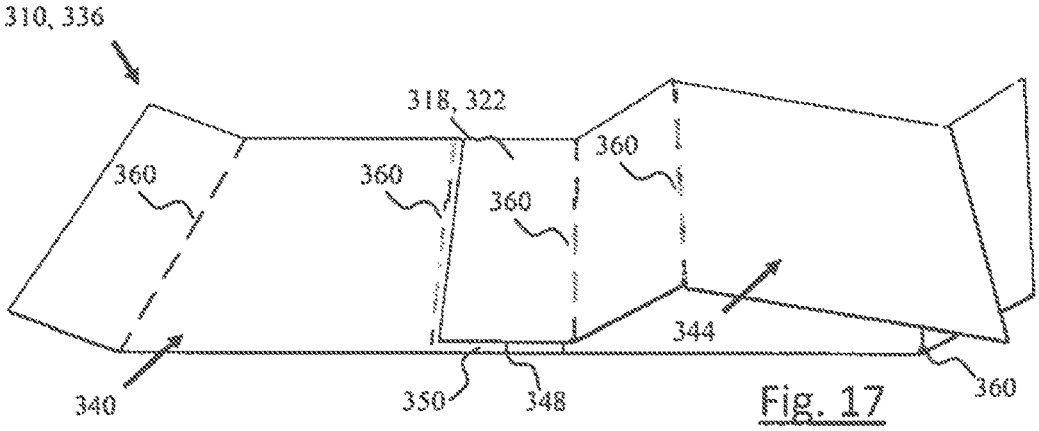
FIG. 17 is an isometric view of an illustrative blank according to the teachings herein.

FIG. 17 is an isometric view of an illustrative blank 336 which is used to form the three-dimensional configuration of an illustrative container 310 according to the teachings herein. The blank 336 may initially be flat. When flat, the blank 336 may be the one-dimensional configuration of the container 310. The blank 336 may include an outer blank 340 and at least one inner blank 342, 344. For example, the blank 336 may include an attached inner blank 344 and an unattached inner blank 342 (not shown). The attached inner blank 344 may have an outward facing surface 348 which is at least partially adhered to an inward facing surface 350 of the outer blank 340. The attached outer blank 344 may be adhered to the outer blank 340 such that the attached inner blank 344 and outer blank 340 lie in substantially the same planes. The attached inner blank 344 may be adhered to the outer blank 340 at one of the side walls 318, for example at the rear side wall 322. The blank 336 may include a plurality of fold lines 360 to aid in defining how to fold the blank 336 to form the container 310.

Figure 18:
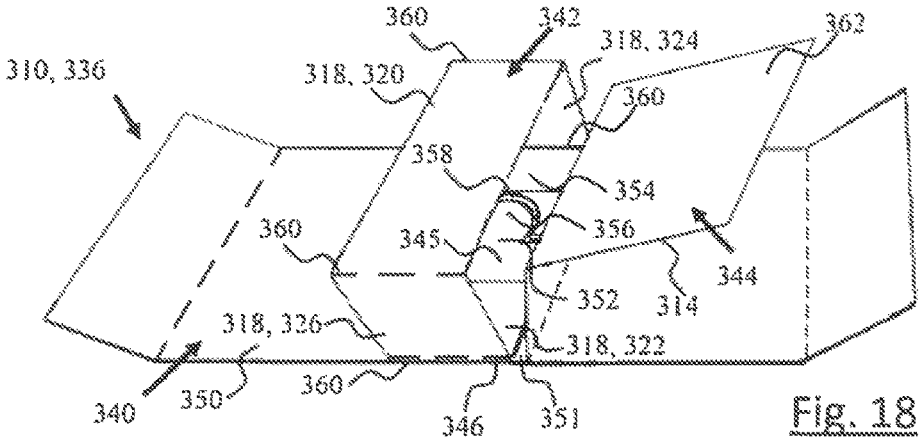
FIG. 18 is an isometric view of an illustrative container being formed from a blank according to the teachings herein.

FIG. 18 is an isometric view of an illustrative blank 336 used to form the three-dimensional configuration of an illustrative container 310 according to the teachings herein. An unattached inner blank 342 may be located on to the blank 336. The unattached inner blank 342 may have a width about the same as the height of the container's 310 side walls. The unattached inner blank 342 may be folded at fold lines 360 to form at least part of a side wall 318, such as the front side wall 320, rear side wall 322, and/or either lateral side wall 324, 326 of the container 310. Preferably, the unattached inner blank 342 may be folded at fold lines 360 to form at least one layer of the front side wall 320, the rear side wall 322, and both lateral side walls 324, 326. The unattached inner blank 342 may include connection features 356, 358 to form at least part of one of the side walls 318. For example, the unattached inner blank 342 may comprise a first end 352 and a second end 354. The first end 352 and second end 354 may include mating features 356, 358, such as the first end 352 including a projection 356 that mates with a cut-out 358 at the second end 354. The unattached inner blank 342 may be located to the blank 336, such as by placing an outward facing surface 346 of the unattached blank 342 to an inward facing surface 350, 351 of either the outer blank 340 or the attached inner blank 344. Preferably, the unattached inner blank 342 is placed such that an outward facing surface 346, more preferably the outward facing surface 346 with connection features 352, 355 is located into direct planar contact with the inward facing surface 351 of the attached inner blank 344, where the attached inner blank 344 is attached to the outer blank 340. To aid in assembly, an adhesive may be used on the unattached inner blank 342. The figure further illustrates the inward facing surface 345 of the unattached inner blank 342 and the peripheral edges 314 along the perimeter of the base insert 362.

Figure 19:
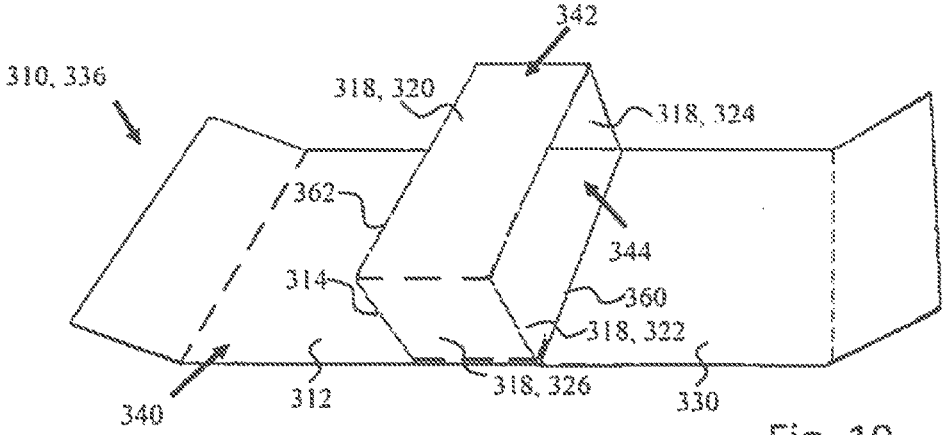
FIG. 19 is an isometric view of an illustrative container being formed from a blank according to the teachings herein.

FIG. 19 is an isometric view of an illustrative blank 336 forming the three-dimensional configuration of an illustrative container 310 according to the teachings herein. The attached inner blank 344 may be folded along a fold line 360 to have a section of the attached inner blank 344 be folded into direct planar contact with the inward facing surface (345, not shown) of the unattached inner blank's 342 back side wall. The attached inner blank 344 may further be folded along a fold line 360 to have a section, such as the base insert 362 of the attached inner blank 344, such that the base insert 362 forms a layer of the base 312 of the container 310. For example, by folding at a fold line 360 and placing the base insert 362 in contact with the side wall portions 318 of the unattached inner blank 342, such that the side wall portions 318 project orthogonally from the perimeter or peripheral edges 314 of the base insert 362.

Figure 20:
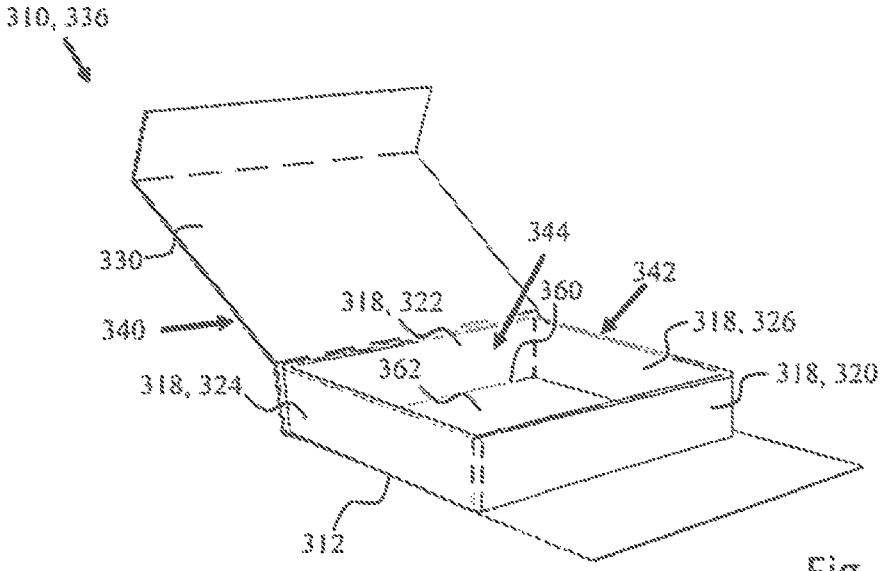
FIG. 20 is an isometric view of an illustrative container being formed from a blank according to the teachings herein.

FIG. 20 is an isometric view of an illustrative blank 336 forming the three-dimensional configuration of an illustrative container 310 according to the teachings herein. The blank 336 may be folded along a fold line 360 such as to create multiple layers along portions of the container, such as multiple layers at the base portion 312. The blank 336 may be folded at a fold line 360 between the rear side wall 322 and the base portion 312 of the outer blank 340, such that the base portion 312 comes into direct and planar contact with the base insert 362 of the attached inner blank 344. Also illustrated are other side walls 318 of the container 310, including the front side wall 320 and lateral side walls 324, 326.

Figure 21:
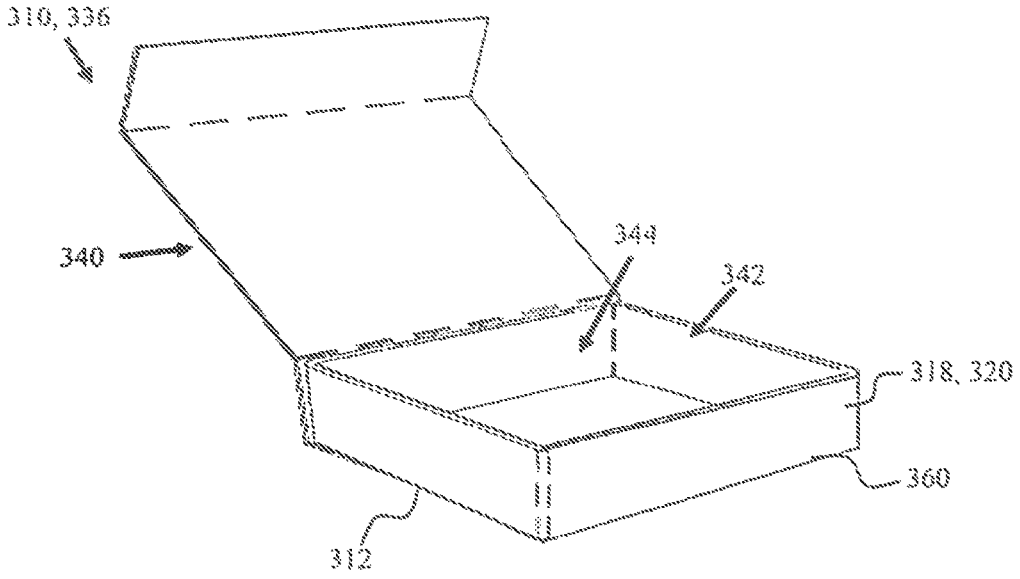
FIG. 21 is an isometric view of an illustrative container being formed from a blank according to the teachings herein.

FIG. 21 is an isometric view of an illustrative blank 336 forming the three-dimensional configuration of an illustrative container 310 according to the teachings herein. The blank 336 may be folded along a fold line 360 such as to create multiple layers along portions of the container, such as multiple layers at the front side wall 320. The blank 336 may be folded at a fold line 360 between the base portion 312 of the outer blank 340 and the front side wall 320 portion of the outer blank 340. The front side wall portion 320 of the outer blank is then placed into direct and planar contact with the front side wall portion 320 of an inner blank, such as the unattached inner blank 342. To maintain the front side wall 320 of the outer blank 340 in position, blank 336 may include one or more attachment features. For example, the front side wall portion of the outer blank 340 may include a magnet, hook and loop fastener, other fastener, or an adhesive (not shown). The front side wall 320 of the unattached inner blank 342 may include a mating attachment feature, such as a polar opposite magnet, a mating hook and loop fastener, or an adhesive (not shown).

Though not necessarily drawn to all geometries relative proportions and dimensions shown in the drawings are also part of the teachings herein, even if not explicitly recited. However, unless otherwise noted, nothing shall limit the teachings herein to the geometries, relative proportions, and dimensions shown in the drawing.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

The explanations and illustrations presented herein are intended to acquaint others skilled in the art with the invention, its principles, and its practical application. Those skilled in the art may adapt and apply the invention its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

What is claimed is:

1. A container comprising:

a) a base portion with a plurality of edges along its perimeter;

b) a lid portion which is distanced from and parallel to the base portion when the container is in a closed configuration;

c) a wall projecting orthogonally from each edge forming a plurality of walls; and d) a blank attachment member;

wherein at least one wall is integrally connected to both the base portion and lid portion;

wherein the container is formed from a blank which is initially flat with a plurality of fold lines;

wherein the blank comprises at least one inner blank which is adhered to an outer blank;

wherein the blank attachment member is a rotation member; and wherein the at least one inner blank, the outer blank, or both are able to rotate about the rotation member.

2. The container of claim 1, wherein the outer blank includes fold lines to form the base portion, the lid portion; and at least one of the walls.

3. The container of claim 2, wherein at least one of the inner blanks includes fold lines to form at least one of the walls.

4. The container of claim 2, wherein at least one of the inner blanks includes cut-outs to form a plurality of the walls.

5. The container of claim 1, wherein at least one of the inner blanks includes fold lines to form the base insert.

6. The container of claim 1, wherein the at least one inner blank is attached to the outer blank with the blank attachment member.

7. The container of claim 1, wherein the at least one inner blank and the outer blank each have a longitudinal axis;

wherein the at least one inner blank's longitudinal axis is parallel to the outer blank's longitudinal axis; and the at least one inner blank can be rotated about the rotation member so that its longitudinal axis is perpendicular the outer blank's longitudinal axis.

8. A container comprising:

a) a base portion with a plurality of edges along its perimeter;

b) a lid portion which is distanced from and parallel to the base portion when the container is in a closed configuration;

c) a wall projecting orthogonally from each edge forming a plurality of walls;

wherein at least one wall is integrally connected to both the base portion and lid portion;

wherein the container is formed from a blank which is initially flat with a plurality of fold lines;

wherein the blank comprises at least one inner blank which is adhered to an outer blank;

wherein the at least one inner blank includes a first aperture and the outer blank includes a second aperture; and wherein the first aperture and the second aperture receive the blank attachment member.

9. The container of claim 8, wherein the outer blank includes fold lines to form the base portion, the lid portion; and at least one of the walls.

10. The container of claim 8, wherein at least one of the inner blanks includes fold lines to form at least one of the walls.

11. The container of claim 8, wherein at least one of the inner blanks includes fold lines to form the base insert.

12. The container of claim 8, wherein at least one of the inner blanks includes cut-outs to form a plurality of the walls.

13. The container of claim 8, wherein the at least one inner blank is attached to the outer blank with a blank attachment member.

14. A container comprising:

a) a base portion with a plurality of edges along its perimeter;

b) a lid portion which is distanced from and parallel to the base portion when the container is in a closed configuration;

c) a wall projecting orthogonally from each edge forming a plurality of walls;

wherein at least one wall is integrally connected to both the base portion and lid portion;

wherein the container is formed from a blank which is initially flat with a plurality of fold lines;

wherein the blank comprises at least one first inner blank which is adhered to an outer blank and at least one second inner blank in direct planar contact with the at least one first inner blank.

15. The container of claim 14, wherein the outer blank includes fold lines to form the base portion, the lid portion; and at least one of the walls.

16. The container of claim 14, wherein at least one of the inner blanks includes fold lines to form at least one of the walls.

17. The container of claim 14, wherein at least one of the inner blanks includes fold lines to form the base insert.

18. The container of claim 14, wherein at least one of the inner blanks includes cut-outs to form a plurality of the walls.

19. The container of claim 14, wherein the at least one inner blank is attached to the outer blank with a blank attachment member.

* * * * *